United States Patent [19]

Yamauchi

[11] Patent Number: 4,836,502

[45] Date of Patent: Jun. 6, 1989

[54] PANTOGRAPH JACK

[75] Inventor: Nobuhiro Yamauchi, Kariya, Japan

[73] Assignee: Aisin Seiki Kabushiki Kaisha, Japan

[21] Appl. No.: 170,390

[22] Filed: Mar. 18, 1988

[30] Foreign Application Priority Data

Mar. 21, 1987 [JP] Japan ..... 62-041631

[51] Int. Cl.[4] ..... B66F 3/22

[52] U.S. Cl. ..... 254/126

[58] Field of Search ..... 254/122, 126, 98, 7 R, 254/7 B, 7 C

[56] References Cited

U.S. PATENT DOCUMENTS

| | | | |
|---|---|---|---|
| 1,536,877 | 5/1925 | Burniston . | |
| 1,714,464 | 5/1929 | Merriman . | |
| 3,679,176 | 7/1972 | Campbell | 254/126 |
| 4,025,054 | 5/1977 | Yamazaki . | |
| 4,695,036 | 9/1987 | Yukimoto et al. | 254/126 |

FOREIGN PATENT DOCUMENTS

| | | |
|---|---|---|
| 52-7626 | 2/1977 | Japan . |
| 1369186 | 10/1974 | United Kingdom . |

*Primary Examiner*—Robert C. Watson

*Attorney, Agent, or Firm*—Finnegan, Henderson, Farabow, Garrett & Dunner

[57] ABSTRACT

A pantograph jack for lifting and lowering a vehicle chassis or the like includes a pair of upper arms and a pair of lower arms pivotally connected to each other by a metal member and a nut member, and a manually operated rod member having a joint portion for supporting the metal member via a bearing member. The rod member is rotatably fitted in the metal member and threadably fitted in the nut member. A flat contact surface is formed on the metal member and is in contact with the bearing member.

3 Claims, 1 Drawing Sheet

PANTOGRAPH JACK

BACKGROUND OF THE INVENTION

1. Field of the Invention

This invention relates generally to pantograph jacks, and more particularly to a pantograph jack for lifting and lowering a vehicle chassis or the like.

2. Description of the Prior Art

Generally, in prior art pantograph jacks, one of a pair of upper arms and one of a pair of lower arms are pivotally mounted with each other by a cylindrical metal member. A bearing member is arranged between the metal member and a joint portion of a manually operated rod member. A spacer is arranged between the metal member and the bearing member, and having a circular arcshaped portion fitted to a cylindrical shape of the metal member at a surface contacting with the metal member and a flat surface at a surface contacting with the bearing member so as to contact the metal member to the bearing member with a plane. However, in the foregoing structure, the manufacturing cost must be increased due to that the space as an additional part is required. Furthermore, play between the spacer and the metal member may occur due to the wear thereof, whereby a rattle occurs by contacting the spacer with the metal member when the manually operated rod member is rotated so as to operate the pantograph jack.

SUMMARY OF THE INVENTION

The present invention has basically solved the foregoing disadvantages in the prior art.

Therefore, one of objects of the present invention is to provide a pantograph jack, wherein the metal member is contacted to the bearing member with a plane by a simple structure.

To complete this object, the pantograph jack comprises a pair of upper arms and a pair of lower arms pivotally connected to each other by a metal member and a nut member, a manually operated rod member having a joint portion for supporting the metal member via a bearing member, the rod member being rotatably fitted in the metal member and threadably fitted in the nut member, and a flat surface formed on a contact surface of the metal member with the bearing member.

Consequently, according to the present invention, the metal member and the bearing member are contacted with each other on a plane of a flat surface of the metal member, whereby a load applied to the metal member is received by a whole of bearing member without any spacers.

BRIEF DESCRIPTION OF THE DRAWINGS

Various other objects, features, and attendant advantages of the present invention will be more fully appreciated as the same becomes better understood from the following detailed description when considered in connection with accompanying drawings.

DETAILED DESCRIPTION OF THE PREFERRED EMBODIMENTS

Figure 1:
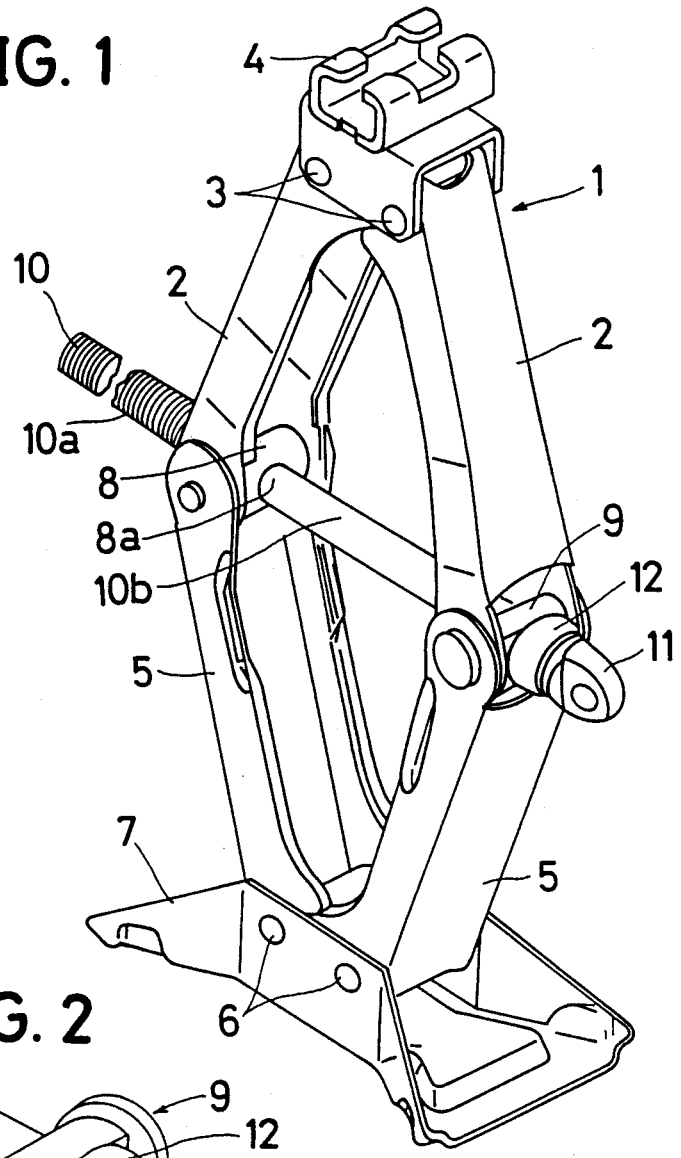
FIG. 1 is a perspective view of one embodiment of the present invention.

Referring how to the drawings, there is shown in FIG. 1, a so-called pantograph jack 1 including a base support 7 on which the movable parts of the jack are supported, a pair of upper arms 2, a pair of lower arms 5, a load mounting stand 4 on which a part of the vehicle chassis (not shown) is to be supported during the lifting and lowering operations, and a manually operated rod member 10 for lifting and lowering the stand 4 through the upper and lower arms 2 and 5.

Each upper end of upper arms 2 is pivotally mounted on the stand 4 by means of pivot pins 3 and in meshing engagement with each other, while each lower end of lower arms 5 is pivotally mounted on the base support 7 by means of pivot pins 6 and in meshing engagement with each other.

The lower end of one of upper arms 2 and the upper end of one of lower arms 5 are pivotally connected to each other by a nut member 8 having a flange portion (not shown) at one end and a journal portion at the other end, while the lower end of the other of upper arms 2 and the upper end of the other of lower arms 5 are pivotally connected to each other by a metal member 9 having a flange portion at one end and a journal portion at the other end.

The arms 2 and 5 of jack 1 are operated by the manually operated rod member 10, having a screw threaded portion 10*a*.

The screw threaded portion 10*a* of the rod member 10 operates within a screw threaded opening 8*a* formed in the nut member 8.

The metal member 9 is similar to the nut member 8 but is provided with a smooth opening (not shown) for slidably supporting a smooth portion 10*b* of the rod 10.

A joint portion 11 is unitarily formed on the rod member 10 at one end of the smooth portion 10*b*. The joint portion 11 supports the metal member 9 via a bearing member 12.

Figure 2:
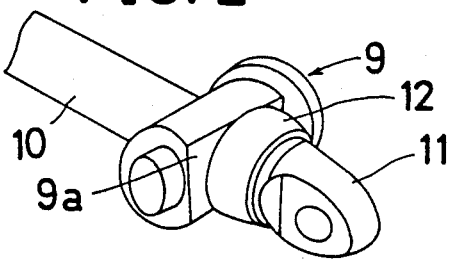
FIG. 2 is an enlarged view of the main part of the present invention in FIG. 1.

As shown in FIG. 2, a contact surface 9*a* of the cylindrically shaped metal member 9 faces the bearing member 12 and is formed to be a flat surface by a plastic working, for example, by cold working. Therefore, the contact between the metal member 9 and the bearing member 12 is a surface contact (not point contact) whereby a load applied to the metal member 9 can receive the whole of the bearing member 12. Furthermore, the contact surface 9*a* becomes hard due to the plastic working whereby noise caused by the contacting of the metal member 9 against the bearing member 12 may be decreased.

Obviously, many modifications and variations of the present invention are possible in light of the above teachings. It is therefore to be understood that within the scope of the appended claims, the invention may be practiced otherwise than as specifically described herein.

What is claimed is:

1. A pantograph jack for lifting and lowering a vehicle chassis or the like comprising:

a pair of upper arms each having a lower end;

a pair of lower arms each having an upper end;

a cylindrically shaped metal member for pivotally connecting the lower end of one of said upper arms and the upper end of one of said lower arms, said metal member having a flat contact surface formed thereon;

said cylindrically shaped metal member having a flange portion at one end thereof and a journal portion at the opposite end thereof, said flange portion and said journal portion connecting said lower end of one of said upper arms and said upper end of one of said lower arms;

a nut member for pivotally connecting the lower end of the other of said upper arms and the upper end of the other of said lower arms; and a manually operated rod member slidably fitted in and supporting said metal member and threadably fitted in said nut member, and having a joint portion including a bearing member for contacting said flat contact surface of said metal member.

2. the pantograph jack of claim 1, wherein said flat surface of said metal member is formed by plastic working.

3. The pantograph jack of claim 2, wherein said flat surface of said metal member is formed by cold working.

* * * * *